United States Patent [19]

Gunn et al.

[11] Patent Number: 4,537,837

[45] Date of Patent: Aug. 27, 1985

[54] CORROSION RESISTANT METAL COMPOSITE WITH METALLIC UNDERCOAT AND CHROMIUM TOPCOAT

[76] Inventors: Walter H. Gunn, 45 Virginia Dr., Painesville, Ohio 44077; Alexander W. Kennedy, 11857 Auburn Rd., Chardon, Ohio 44024

[21] Appl. No.: 578,010

[22] Filed: Feb. 13, 1984

Related U.S. Application Data

[63] Continuation-in-part of Ser. No. 475,734, Mar. 16, 1983, Pat. No. 4,500,610.

[51] Int. Cl.[3] ..... C23C 1/02; C23F 7/10

[52] U.S. Cl. ..... 428/621; 428/632; 428/328; 204/28; 204/38.1; 148/6.2

[58] Field of Search ..... 428/621, 628, 632; 204/28; 148/6.2

[56] References Cited

U.S. PATENT DOCUMENTS

| | | | |
|---|---|---|---|
| 2,419,231 | 4/1947 | Schantz | 29/191.6 |
| 3,420,754 | 1/1969 | Roehl | 204/28 |
| 3,671,331 | 6/1972 | Malkin et al. | 148/6.2 |
| 3,687,739 | 8/1972 | Kennedy et al. | 148/6.2 |
| 3,909,209 | 9/1975 | Kruper et al. | 428/621 |
| 4,079,163 | 3/1978 | Tanaka et al. | 428/328 |
| 4,216,272 | 8/1980 | Clauss | 428/632 |
| 4,282,073 | 8/1981 | Hirt et al. | 204/28 |
| 4,314,893 | 2/1982 | Clauss | 204/40 |
| 4,351,713 | 9/1982 | Hirt et al. | 204/207 |
| 4,374,902 | 2/1983 | Smith et al. | 428/621 |
| 4,388,160 | 6/1983 | Pynne | 204/38 R |
| 4,411,964 | 10/1983 | Hara et al. | 428/626 |

FOREIGN PATENT DOCUMENTS

| | | |
|---|---|---|
| 3330543A | 7/1983 | Fed. Rep. of Germany . |
| 46-63416 | 8/1971 | Japan . |
| 55-16349 | 2/1980 | Japan . |
| 55-110792 | 8/1980 | Japan . |
| 55-158262 | 12/1980 | Japan . |
| 56-020190 | 2/1981 | Japan . |
| 098216 | 6/1981 | Japan . |
| 58019492 | 7/1981 | Japan . |
| 56-130477 | 10/1981 | Japan . |
| 57-174469 | 10/1982 | Japan . |
| 57-207199 | 12/1982 | Japan . |

*Primary Examiner*—Veronica O'Keefe
*Attorney, Agent, or Firm*—John J. Freer

[57] ABSTRACT

A coating composite provides extended corrosion resistance for substrate metals. The thin metallic undercoat of the composite contains combined metals. The heat curable and substantially resin free topcoat is established from composition containing chromium in non-elemental form, which topcoat composition may further contain particulate metal, all in liquid medium. In addition to outstanding corrosion resistance, the composite can retain substrate weldability as well as achieving formability, while further enhancing paintability and weatherability.

21 Claims, No Drawings

CORROSION RESISTANT METAL COMPOSITE WITH METALLIC UNDERCOAT AND CHROMIUM TOPCOAT

CROSS-REFERENCE TO RELATED APPLICATION

This application is a continuation-in-part of U.S. patent application Ser. No. 475,734, filed Mar. 16, 1983 now U.S. Pat. No. 4,500,610.

BACKGROUND OF THE INVENTION

The tendencies of iron or steel surfaces to corrode is well known. Zinc is one of the most widely used metallic coatings applied to steel surfaces to protect them from corrosion. In the past, the principal methods of applying such coatings were hot-dipping, also known as galvanizing and the electroplating of a zinc layer onto the steel. Zinc has been electroplated on the steel surfaces from various plating baths, preferably from acid plating baths, for providing protection of steel surfaces for various uses.

It has been known as in the U.S. Pat. No. 2,429,231 to improve the corrosion resistance of the coating layer by using for the coating an alloy high in zinc and low in nickel. This alloy is co-deposited from the electrolytic plating bath onto the steel substrate. Continuous steel strip, alloy-plated in accordance with the teachings of the patent, when subjected to forming and finishing operations, tends to form cracks in the coating because of the brittleness of the alloy. However, subsequent improvements, as in U.S. Pat. No. 3,420,754 teaching an improvement in corrosion resistance by a slight increase in the nickel content of the deposited alloy, have been forthcoming. Moreover, improvements in electroplate uniformity and further corrosion improvement by nickel priming have been accomplished as disclosed in U.S. Pat. No. 4,282,073.

Also, as an after-treatment, the electroplated surface can be subjected to a chromate rinse, such as disclosed in Japanese Patent Disclosure No.: Showa 55-110792. In some cases with substrates protected with alloyed zinc-plated layers it has been proposed to subsequently treat the surface with a chromate conversion coating, as has been shown in Japanese Patent Disclosure No.: Showa 57-174469. However, as in all matters pertaining to corrosion-resistance, applications which lengthen the corrosion-resistance of the coated substrate can be a desirable improvement. Thus in U.S. Pat. No. 4,411,964 it has been taught to not only apply a chromate coating to the metal substrate, but to also topcoat the chromate film with silicate resin film.

It has also been known to protect steel surfaces against corrosion by using coating compositions that contain a hexavalent-chromium-providing substance as well as further containing a finely divided metal. For example, U.S. Pat. No. 3,687,739 discloses the preparation of a treated metal surface wherein such treatment includes application of a composition containing, among other constituents but as critical ingredients, chromic acid and a particulate metal. As has been disclosed in U.S. Pat. No. 3,671,331 the metals of the substrate for protection are advantageously metals from copper through zinc, inclusive, on the electromotive force series, as well as alloys of such metals wherein such metals are present in major amount. After the chromium containing bonding compositions are applied to such metal substrate, they are most always topcoated with a weldable primer topcoat composition. Such topcoats may then be cured by elevated temperature baking. It has also been known to coat zinc plated steel, typically in sheet form, with weldable zinc rich primers. Thus, in U.S. Pat. No. 4,079,163 it is shown to coat weldable primer over chromate treated galvanized steel.

It would however be further desirable to protect ferrous metals in corrosive environments, by extending even further the corrosion resistance by coating technique. It would be also desirable to provide the resulting coated article with a wide variety of worthwhile characteristics. Exemplary of these would be coating adhesion during metal forming operation, plus retention of weldability where the coated substrate would otherwise be weldable. It would be well to be able to provide coating compositions and procedures tailored to fast, economical operations, especially for the coating of steel in coil form, so as to provide an enhanced product for the automotive industry quickly and economically.

SUMMARY OF THE INVENTION

It has been found possible to provide coated metal substrates with outstanding corrosion resistance. Furthermore, coating characteristics are not diminished. Rather, shear adhesion of the coating to the substrate metal can be enhanced. In addition to outstanding corrosion resistance, the composite can retain substrate weldability, while further enhancing paintability and weatherability.

Metal substrates which have otherwise heterofore been subject to poor performance in metal deformation, e.g., in metal stamping and forming operations, such poor performance even including complete metal failure, have now been surprisingly found to be free from such problem. Most noteworthy, this has been accomplished in a coated metal article as opposed to a strict metallurgical approach to the problem.

Moreover, with newly developed high-strength, low-alloy steels, such characteristics are achieved in energy-efficient, low-temperature coating operation which are not deleterious to the inherent strain characteristics of the substrate metal. The resulting article, e.g., continuously annealed and coated steel with enhanced resistance to corrosion attack as well as further desirable characteristics, e.g., weldability and formability, can be achieved in fast, economical operation and is of particular interest for automotive use.

In one aspect, the present invention is directed to a coated metal substrate having enhanced corrosion resistance and protected by a coating composite comprising a thin metallic undercoating layer of combined metals in metallic form at least one of which is selected from the group consisting of zinc, nickel, iron, chromium, aluminum and cobalt, and a heat-curable, substantially resin free topcoat layer from composition curable to a water resistant protective coating. The topcoat layer contains particulate metal as well as above 20 milligrams per square foot of chromium, as chromium, in non-elemental form, with the composition containing hexavalent-chromium-providing substance in liquid medium.

In another aspect the invention is directed to such coated metal substrates wherein there is first applied to the substrate a metallic pretreatment prior to application of the thin metallic undercoating layer. Other aspects of the invention include coated metal substrates in sheet or strip form as well as methods of preparing all of the described coated metal substrates.

DESCRIPTION OF THE PREFERRED EMBODIMENTS

The metal substrates contemplated by the present invention are exemplified by any of the metal substrates to which a combination metallic coating can be applied. For example, such metal substrates may be aluminum and its alloys, zinc and its alloys, copper and cupriferous, e.g., brass and bronze. Additionally, exemplary metal substrates include cadium, titanium, nickel, and its alloys, tin, lead, chromium, magnesium and alloys thereof, and for weldability, preferably a ferrous metal substrate such as iron, stainless steel, or steel such as cold rolled steel or hot rolled and pickled steel. All of these for convenience are usually referred to herein simply as the "substrate".

Such substrate may first receive a pretreatment before undercoating. For example, a thin metallic nickel pretreatment, or nickel "strike" layer, such as on the order of about one micron thickness or so, may be deposited before a nickel/zinc alloy coating. Or a copper pretreatment or "flash" coating layer can precede the electroplating of a zinc alloy. Other metallic pretreatments can include cobalt and tin. Such metallic pretreatments will typically be present on the substrate in a thickness not exceeding about one micron, and usually less, e.g., 0.1 micron or less, and more typically within the range from 0.1 to 0.5 micron. After application of the pretreatment layer it can be subjected to heating prior to undercoating. For example, a nickel strike pretreatment on a ferrous metal substrate might be annealed prior to subsequent undercoating. Other pretreatments of the substrate prior to undercoating, and different from the deposition of a metallic strike or flash coating can be useful. These may include etching of the substrate metal, such as to enhance metallic undercoat adhesion to the substrate.

The metallic undercoating of a combined metals in metallic form will most typically be at least one layer of metals in alloy form, although metallic mixtures are also contemplated. It has been conventional in the art to discuss such metal combinations as being "alloys" and thus such term is used herein. These combinations are however also referred to herein for convenience as "codeposits." Hence if such combinations are not strictly uniform metallurgical alloys they are nevertheless useful for the present invention and such combinations are meant to be included herein. Such undercoating codeposits will almost always have at least one layer of a zinc-containing alloy. Such alloy will usually contain from as little as about 30 to 40 weight percent, up to a maximum of about 90 to even about 95 weight percent, of zinc, all basis the metallic undercoating weight. For example, zinc-aluminum alloys and zinc-iron alloys may contain a preponderant amount of the aluminum or the iron, there typically being, on the order of about 55 to about 60 weight percent or more of such aluminum or iron. At elevated zinc amounts, useful zinc-cobalt alloys can be exemplary, some containing as little as 10 weight percent or less of cobalt. Generally the useful alloying metals will include nickel, cobalt, manganese, chromium, tin, copper, aluminum, antimony, magnesium, lead, calcium, beryllium, iron, silicon and titanium. Such metals can be expected to be present in a minimum weight amount of about 0.2–0.5 weight percent or so, it being understood that the alloys may additionally contain elements, including those metals listed above, in trace amounts, e.g., in an amount from less than the about 0.2–0.5 weight percent range down to 0.001 weight percent or less of the alloy.

Specifically useful alloy undercoatings include zinc-iron alloys, which can be dominated in metallic content by either the iron or the zinc, often containing from about 60 down to about 10 weight percent iron. The zinc-aluminum alloys, already mentioned hereinbefore for potentially containing a preponderance of aluminum, can, on the other hand be quite high in zinc. This may particularly be the case when a third alloying metallic element is included, e.g., a zinc-aluminum with an even more minor amount of several tenths of a weight percent of magnesium. Serviceable zinc-cobalt alloys may include 0.5 to about 20 weight percent cobalt, or the cobalt may serve as a third alloying element in minor amount, such as in a zinc-nickel-cobalt alloy which may contain on the order of about 5 to 30 weight percent of the two alloy elements excluding zinc.

It is to be understood, however, that the useful zinc-containing undercoating alloy may be in combination with up to seven to eight or more of other alloying elements. Particularly preferred undercoatings for economy and enhanced corrosion resistance are the zinc-nickel alloys. These can contain zinc in major amount, although alloys of at least 80 percent nickel have been shown in U.S. Pat. No. 4,416,737. But almost always these alloys have nickel present in an amount less than about 25 weight percent and most generally in an amount below about 20 weight percent. On the other hand, as little as about 4 to 6 weight percent may be present so that most typically from about 5–20 weight percent of the nickel is present in the alloy. Such amount of nickel can, in part, depend upon the other elements present, e.g., a minor amount of cobalt as discussed hereinabove, wherein the nickel content of the undercoating will often be more elevated than in the more simplistic zinc-nickel systems. For such preferred undercoatings, the balance will be zinc, it being understood that trace amounts of additional ingredients other than nickel and zinc may be present.

Although the metallic undercoating will most typically be a layer of zinc-containing alloy, other servicable layers are contemplated and have been found to be useful, such as nickel-cobalt codeposits. They may be used as one of a layerd composite, e.g., as a first layer with a zinc-containing alloy second layer. These other layers include such as are readily commercially available. These are preponderantly iron-containing alloys. Although iron containing alloys are not preferred for best corrosion performance, unless the iron is present as one of several alloying elements, and then also in minor amount, these can nevertheless be useful in composites. For example, the undercoat may consist of first a zinc-iron layer, e.g., an electrodeposited first layer of same, with a preferred zinc-nickel toplayer to form a double layer undercoat of enhanced characteristics. It is usually desirable that the composite have a base layer that is more noble than its covering layer but less noble than the substrate metal, e.g., a substrate of steel.

The method of applying the undercoating will in general be determined by the economy of application for the particular undercoating selected. For example, with the zinc-iron undercoatings such may be applied by usual zinc application to an iron substrate followed by annealing. On the other hand the preferred zinc-nickel undercoatings may be applied by electrolytic application, including deposition technique relying on subsequent heating for alloying. Electroless deposition and molten alloy coating techniques are also contemplated. Most typically, regardless of the means of application, the metallic undercoating layer will be present on the metal substrate in an amount of less than about 25 microns thickness. Greater amounts can be uneconomical as well as leading to thick coatings which may be deleteriously brittle. For best economy coupled with highly desirable corrosion resistance, such metallic undercoating layer will advantageously be present in a thickness on the metal substrate of below about 15 microns, and often on the order of about 10 microns or less. On the other hand, undercoats of about 0.1 micron thickness or so are generally insufficient for providing outstanding enhancement in corrosion resistance. Therefore the metallic undercoating will be present in a thickness of at least about 0.2 micron, and more typically in at least about 0.3 micron thickness, such that there will most preferably be present a metallic undercoat layer of from about 0.25 to about 5 microns.

Of particular interest as particulate-metal-containing, as well as hexavalent-chromium-containing, topcoatings for the present invention are bonding coatings. Those that are preferred may be based upon succinic acid and other dicarboxylic acids of up to 14 carbon atoms as the reducing agents, which agents have been disclosed in U.S. Pat. No. 3,382,081. Such acids with the exception of succinic may be used alone, or these acids can be used in mixture or in mixture with other organic substances exemplified by aspartic acid, acrylamide or succinimide. Additionally useful combinations that are particularly contemplated are combinations of mono-, tri- or polycarboxylic acids in combination with additional organic substances as has been taught in U.S. Pat. No. 3,519,501. Also of particular interest are the teachings in regard to reducing agent, that may be acidic in nature, and have been disclosed in U.S. Pat. Nos. 3,535,166 and 3,535,167. Of further particular interest are glycols and glycol-ethers and many representative compounds have been shown in U.S. Pat. No. 3,679,493.

Other compounds may be present in the hexavalent-chromium-containing liquid composition, but, even in combination, are present in very minor amounts so as not to deleteriously affect the coating integrity, e.g., with respect to weldability. Thus, such compositions should contain 0–40 grams per liter of resin, i.e., are substantially resin-free. Since the role of the chromium-providing-substance is partially adhesion, such coating compositions are preferably resin-free. Moreover the total of phosphorous compounds should be minute so as not to deleteriously interfere with coating weldability. Preferably the compositions contain no phosphorous compounds, i.e., are phosphate-free. The other compounds that may be present include inorganic salts and acids as well as organic substances, often typically employed in the metal coating art for imparting some corrosion resistance or enhancement in corrosion resistance for metal surfaces. Such materials include zinc chloride, magnesium chloride, various chromates, e.g., strontium chromate, molybdates, glutamic acid, zinc nitrate, and polyacrylic acid and these are most usually employed in the liquid composition in amount totaling less than about 15 grams per liter.

The topcoatings contain a particulate metallic pigment, preferably a metal such as aluminum, manganese, zinc and magnesium, or their mixtures, but which may also include substances such as ferroalloys. Preferably, for efficiency and economy, such metal is zinc, or aluminum, or their mixtures. The pulverulent metal can be flake, or powder, or both but should have particle size such that all particles pass 100 mesh and a major amount pass 325 mesh ("mesh" as used herein is U.S. Standard Sieve Series). Advantageously, for preparing a coated substrate having augmented uniformity in the distribution of the pulverulent metal, as well as enhanced bonding of metal to the substrate, the pulverulent metal employed is one wherein essentially all particles, e.g., 80 weight percent or more, pass 325 mesh. The particulate metals have been disclosed as useful in bonding coating compositions containing a hexavalent-chromium-providing substance and reducing agent therefor in liquid medium, such as disclosed in U.S. Pat. No. 3,671,331.

Substantially all of the topcoating compositions are simply water based, ostensibly for economy. But for additional or alternative substances, to supply the liquid medium at least for some of these compositions, there have been taught, as in U.S. Pat. No. 3,437,531, blends of chlorinated hydrocarbons and a tertiary alcohol including tertiary butyl alcohol as well as alcohols other than tertiary butyl alcohol. It would appear then in the selection of the liquid medium that economy is of major importance and thus such medium would most always contain readily commercially available liquids.

Chromium may typically be present in the hexavalent state by incorporation into the topcoating compositions as chromic acid or dichromate salts or the like. During the curing of the applied coatings composition, the metal is susceptible to valency reduction to a lower valence state. Such reduction is generally enhanced by the reducing agent in the composition, when present. For enhanced corrosion resistance the resulting coating will provide at least about 20 percent hexavalent chromium, basis total topcoat chromium, up to about 50 percent of hexavalent chromium. More typically from about 20 to about 40 percent of the topcoating chromium will be in the hexavalent state after curing of the topcoat.

When the topcoating is first established, the applied coating will be non-water resistant. The topcoatings contemplated as useful in the present invention are those which will cure at generally moderate elevated temperature. They can be typically cured by forced heating at such moderately elevated temperature. In general, the curing conditions are temperatures below 550° F. metal temperature, and at such temperature, for times of less than about 2 minutes. However, lower temperatures such as 300°–500° F., with curing times, such as 0.5–1.5 minutes are more typically used, with a range of 300°–400° F. being preferred with continuously annealed steels. Hence, the most serviceable topcoats lend themselves to fast and economical overall coating operation, such as will be useful with exemplary steel substrates in strip or coil form.

The resulting weight of the topcoating on the metal substrate may vary to a considerable degree, but will always be present in an amount supplying greater than 20 milligrams per square foot of chromium, measured as chromium and not as $CrO_3$. A lesser amount will not lead to desirably enhanced corrosion resistance. Advantageously, greater than about 25 milligrams per square foot of coated substrate of chromium will be present for best corrosion resistance, while most typically between about 25–500 milligrams per square foot of chromium, always expressed as chromium and not $CrO_3$, will be present. The particulate metal should be present on the coated metal substrate in an amount between about 50 and about 5,000 milligrams per square foot of pulverulent metal and the topcoating preferably have a weight ratio of chromium to pulverulent metal of not substantially above about 0.5:1.

Before starting the treatment of the present invention it is, in most cases advisable to remove foreign matter from the metal surface by thoroughly cleaning and degreasing. Degreasing may be accomplished with known agents, for instance, with agents containing sodium metasilicate, caustic soda, carbon tetrachloride, trichlorethylene, and the like. Commercial alkaline cleaning compositions which combine washing with mild abrasive treatments can be employed for cleaning, e.g., an aqueous trisodium phosphate-sodium hydroxide cleaning solution. In addition to cleaning, the substrate may undergo cleaning plus etching.

The resulting coated substrate can be further topcoated with any suitable paint, i.e., a paint primer, including electrocoating primers and weldable primers such as the zinc-rich primers that may be typically applied before electrical resistance welding. For example, it has already been shown in U.S. Pat. No. 3,671,331 that a primer topcoating containing a particulate, electrically conductive pigment, such as zinc, may be used to coat a metal substrate that is first treated with a coating which itself contains a pulverulent metal such as finely divided zinc. Such zinc-rich primer topcoating is, however, almost always avoided as it may have the effect, surprisingly, of downgrading some characteristics of the final prepared article.

Where topcoats nevertheless are to be used, other representative weldable primers containing an electrically conductive pigment plus binder in a vehicle have been disclosed for example in U.S. Pat. No. 3,110,691, teaching a suitable zinc paste paint composition for application to a metallic surface prior to welding. Other topcoating formulations, although applicable to a metal substrate without weldability in mind, contain particulate zinc along with zinc oxide. Other topcoating systems have been referred to in the prior art as "silicate coatings." These may be aqueous systems containing a finely divided metal such as powdered zinc or aluminum, lead, titanium, or iron plus a water soluble or water dispersible binder. Representative of the binders are alkali metal silicates, inorganic silicate esters, or a colloidal silica sol.

Other topcoating paints may contain pigment in a binder or can be unpigmented, e.g., generally cellulose lacquers, rosin varnishes, and oleoresinous varnishes, as for example tung oil varnish. The paints can be solvent reduced or they may be water reduced, e.g., latex or water-soluble resins, including modified or soluble alkyds, or the paints can have reactive solvents such as in the polyesters or polyurethanes. Additional suitable paints which can be used include oil paints, including phenolic resin paints, solvent-reduced alkyds epoxys, acrylics, vinyl, including polyvinyl butyral and oil-wax-type coatings such as linseed oil-paraffin wax paints.

The following examples show ways in which the invention has been practiced but should not be construed as limiting the invention. In the examples, the following procedures have been employed.

Preparation of Test Parts

Test parts are typically prepared for coating by first immersing in water which has incorporated therein 2 to 5 ounces of cleaning solution per gallon of water. The alkaline cleaning solution is a commercially available material of typically a relatively major amount by weight of sodium hydroxide with a relatively minor weight amount of a water-softening phosphate. The bath is maintained at a temperature of about 120° to 180° F. Thereafter, the test parts are scrubbed with a cleaning pad which is a porous, fibrous pad of synthetic fiber impregnated with an abrasive. After the cleaning treatment, the parts are rinsed with warm water and may be dried.

Application of Coating to Test Parts and Coating Weight

Clean parts are typically coated by dipping into coating composition, removing and draining excess composition therefrom, sometimes with a mild shaking action, and then immediately baking or air drying at room temperature until the coating is dry to the touch and then baking. Baking proceeds in a hot air convection oven at temperatures and with times as specified in the examples.

Topcoating weights for coated articles, as chromium, and not as $CrO_3$, and as particulate metal, e.g., zinc, both being typically in weights in milligrams per square foot of coated substrate, have been presented in the examples. Such weights are determined by a Portaspec x-ray fluorescence spectroscope manufactured by Pitchford Corporation. The lithium fluoride analyzing crystal is set at the required angle to determine chromium, and at the required angle to determine zinc. The instrument is initially standardized with coatings containing known amounts of these elements. The machine is adapted with a counter unit and the count for any particular coating is translated into milligrams per square foot by comparison with a preplotted curve.

Corrosion Resistance Test (ASTM B117-73) and Rating

Corrosion resistance of coated parts is measured by means of the standard salt spray (fog) test for paints and varnishes ASTM B117-73. In this test, the parts are placed in a chamber kept at constant temperature where they are exposed to a fine spray (fog) of a 5 percent salt solution for specified periods of time, rinsed in water and dried.

Prior to placing in the chamber, and when deformation is mentioned in the examples, a portion of the test part is deformed, in the nature of a "dome", by first firmly positioning the part so that the subsequent dome portion corresponds to the circular die of the deforming apparatus. Thereafter, a piston with a ball bearing end is used to deform the portion of the test part through the die into the dome shape. The dome height is 0.30 inch. The extent of corrosion on the test parts is determined by inspecting only the dome and comparing parts one with another, and all by visual inspection.

EXAMPLE 1

There is formulated, with blending, a topcoating composition containing 20 grams per liter of chromic acid, 3.3 grams per liter of succinic acid, 1.7 grams per liter of succinimide, 1.5 grams per liter of xanthum gum hydrophillic colloid, which is a heteropolysaccharide prepared from the bacteria specie *Xanthamonas camperstris* and has a molecular weight in excess of 200,000. Additionally, the composition contains 1 milliliter of formalin, 7 grams per liter of zinc oxide, 120 grams per liter of zinc dust having an average particle size of about 5 microns and having all particles finer than about 16 microns, and 1 drop or so per liter of a wetter which is a nonionic, modified polyethoxide adduct having a viscosity in centipoises at 25° C. of 180 and a density of 25° C. of 8.7 lbs. per gallon. After mixing all of these constituents, this topcoating composition is then ready for coating test panels.

The parts for testing are either cold-rolled steel panels or are commercially available coated steel test panels having an about 0.5 micron thick metallic nickel strike layer on the steel substrate and an about 3 micron thick nickel/zinc alloy undercoating, containing about 15 weight percent nickel, deposited by electrodeposition. The panels are topcoated, by dipping in the above described coating composition, removing and draining the excess composition therefrom. The topcoated panels are then baked up to 3 min. at 500° F. air temperature in a convection oven. The topcoating is judged to be of similar weight among test panels and is measured on the cold-rolled steel test panel to contain 27 mg/sq. ft. chromium, as chromium, and 310 mg/sq. ft. of particulate zinc. Coated panels are subjected to the hereinabove described corrosion resistance test and the results are reported in the table below.

TABLE 1

| Coating On Cold-Rolled Steel | Salt Spray Corrosion On Formed Panels % Red Rust | - Hours |
|---|---|---|
| Topcoat (Comparative) | 20% | 96 |
| Nickel/Zinc Alloy Coat (Comparative) | 5% | 96 |
| Nickel/Zinc Alloy Coat & Topcoat | 0% | 1,824 |

EXAMPLE 2

Cold-rolled steel panels, 4×4 inch in size, are alkaline cleaned in the manner described hereinbefore followed by an acid dip in ten percent sulfuric acid maintained at 66° C. These cleaned panels were then introduced to a nickel "strike" bath maintained at a temperature of 60° C. and having a nickel anode and the cold-rolled steel as cathode. The nickel strike coating of about 0.3 micron thickness was deposited at a current density of 36.5 amperes per square foot ("ASF") in a 20 seconds dip time. This bath contained 44 ounces per gallon of nickel sulfate ($NiSO_4.6H_2O$), 6 ounces per gallon of nickel chloride ($NiCl_2.6H_2O$), 5 ounces per gallon boric acid and 76 milliliters per gallon of an aqueous solution containing 2 percent by volume of wetting agent which was a nonionic alkyl phenoxypolyoxyethylene ethanol. All ingredients were dissolved in deionized water.

After rinsing, the panels containing the nickel strike were introduced into a nickel/zinc bath maintained at a temperature of 60° C. and were employed therein as cathodes. The bath had a nickle anode. A nickel/zinc codeposit coating of approximately 12 weight percent nickel and of approximately 5 microns coating thickness was deposited at a current density of 60 ASF in 125 seconds plating time. This bath contained 27.3 ounces per gallon of zinc chloride, 12.3 ounces per gallon of nickel chloride ($NiCl_2.6H_2O$) and 76 milliliters per gallon of the above described wetting agent, with all ingredients being dissolved in deionized water.

The panels now containing the nickel strike plus nickel/zinc codeposit coating were immediately rinsed and then either rinsed again or alkaline cleaned in the manner described hereinabove. During the second rinse, or alkaline cleaning, panels were manually rubbed with a rubber glove. One test panel was then topcoated in the manner described hereinbefore in connection with the examples using the topcoat composition of Example 1 and the particular procedures of Example 1. The test panel was found to contain 27 mg/sq. ft. chromium, as chromium, and 310 mg/sq. ft. of particulate zinc.

To prepare a comparative test panel not representative of the present invention, a second test panel was dipped into a chromate conversion coating bath containing 7.5 g/l of chromic acid and 2.5 g/l of sodium sulfate. The bath was adjusted to a ph of about 1.8 with sulfuric acid. Before chromate coating, the panel was activated by dipping in an activator solution of 0.4 percent nitric acid. After chromate coating the panel was water rinsed and then was permitted to air dry. The resulting chromate conversion coating was found to provide approximately 3 mg/sq. ft. of chromium. This comparative panel, not illustrative of the present invention, was then subject to the above described corrosion resistance test, along with the panel of the present invention, and the results are recorded in the table below.

TABLE 2

| Coating on Cold-Rolled Steel | Salt Spray Corrosion Hours to Failure |
|---|---|
| Nickel-Nickel/Zinc Codeposit with chromium/particulate zinc topcoat | 1,433 |
| Nickel-Nickel/Zinc Codeposit with chromate conversion coating (Comparative) | 377 |

EXAMPLE 3

Cold-rolled steel panels were cleaned in the manner described hereinbefore in connection with the examples. After cleaning, the panels for testing were introduced into a bath maintained at room temperature and containing a nickel anode and the cold-rolled steel as cathode. A nickel-cobalt codeposit coating of approximately 21% nickel and 79% cobalt was deposited using a current density of about one ASF in 72 seconds coating time. The bath contained 54.5 grams per liter (g/l) of cobalt chloride ($CoCl_2.6H_2O$) and 54.5 g/l of nickel chloride ($NiCl_2.6H_2O$) and 15 g/l of boric acid all dissolved in deionized water.

After rinsing and drying a test panel was topcoated with the composition of Example 1 in the manner described hereinbefore in connection with the examples using the particular parameters of Example 1. The topcoating was found to contain 30 mg/sq. ft. of chromium, as chromium, and 405 mg/sq. ft. of particulate zinc. This topcoated panel was subjected to the above described corrosion resistance test and had a test life to first red rust of 724 hours.

EXAMPLE 4

Test panels all being cold-rolled steel panels, were alkaline cleaned in the manner described hereinbefore in connection with the examples, except that after scrubbing the parts were manually rubbed with a rubber glove prior to rinsing. A nickel strike layer was then applied using a nickel bath as described in Example 2 employing a plating time of 15 seconds per panel and a current density of 36 ASF. A nickel/zinc codeposit layer was then applied using a nickel/zinc bath as described in Example 2 and a plating time of 15 seconds at a current density of 60 ASF. The coating weight for the nickel strike layer was about 1.9 grams per square meter ($g/m^2$) and for the nickel/zinc codeposit layer was about 3.2 $g/m^2$ and the alloy was approximately 15 weight percent nickel. The panels were next topcoated using the procedure described hereinbefore in connection with the examples and the topcoat composition used was as described in Example 1 and the Example 1 coating procedure were also employed. The topcoating weight was found to contain 28 mg/sq. ft. chromium, as chromium, and 330 mg/sq. ft. of particulate zinc.

These panels were then subjected to an extended electrical resistance spot welding test such as has found acceptance in the automotive industry. The electrode size used for the test was 0.190 inch. The electrodes used all had a Rockwell hardness value of B78. For the duration of the test, twenty one-half cycles secondary welding current was used and the kiloamps varied from 7.6 to 8.2. The results of this spot weld testing are reported in the Table below.

TABLE 3

| Number of Spot Welds | Spot Weld Size* |
|---|---|
| Start | 0.197 × 0.228 |
| 1000 | 0.191 × 0.252 |
| 2000 | 0.190 × 0.250 |
| 3000 | 0.196 × 0.252 |
| 4000 | 0.185 × 0.241 |

*Minimum nugget weld size for passing is 0.160 inch.

After the 4,000 spot welds, the test is simply terminated with no failures. All welds are determined to have passed and this is regarded as outstanding as the test has been carried out through a full 100% greater number of welds than required to pass the test.

EXAMPLE 5

The cold-rolled steel panels for testing were prepared by cleaning in the manner described hereinbefore in connection with the examples. Panels used included commercially available coated steel material having approximately 94 microinches thick metallic nickel/zinc alloy coating containing about 15 weight percent nickel. The alloy coating had been electrolytically deposited. The balance of the panels used had initially applied to the steel substrate a nickel layer, using a Watts nickel bath as described in Example 2 with a nickel anode and a plating time of 15 seconds at 36.5 ASF. To this initial nickel layer there was electrodeposited a nickel/zinc layer applied using a nickel/zinc bath as described in Example 2 having a nickel anode and a plating time of 15 seconds and 60 ASF. The total coating thickness for these panels was about 0.5 micron which contained about 15 weight percent nickel in the codeposit layer.

Six test panels of the commercially available product as well as six test panels containing the initial nickel layer and subsequent nickel/zinc alloy layer, were then topcoated using the topcoat composition of Example 1. The topcoat procedure employed was that described hereinbefore in connection with the examples as well as the technique described in Example 1. All panels, including three panels of the commercially available material, but which had not been topcoated, were then deformed in the manner described hereinbefore in connection with the examples. All panels were then subjected to the hereinabove described corrosion resistance test. During the test, panels were rated on the extruded or "dome" side of the panel which is the coated side for the topcoated panels. Panels were tested to failure using a 5 rating as failure and using the rating system discussed hereinbelow in Example 6. Corrosion resistance results are reported in the Table below.

TABLE 4

| Coating on Cold-Rolled Steel | Salt Spray Corrosion On Formed Panels Hours to Failure |
|---|---|
| Commercial Nickel/Zinc Codeposit Coat (Comparative) | 192* |
| Nickel-Nickel/Zinc Codeposit Coat plus Topcoat | 972** |
| Commercial Nickel/Zinc Codeposit Coat plus Topcoat | 1236** |

*Median for three panels.
**Median for six panels.

EXAMPLE 6

The test panels selected were those as have been described in Example 6 containing the first nickel layer plus nickel/zinc alloy layer. One of these panels is treated in a manner representative of the present invention by using the coating composition of Example 1, in the manner as described hereinbefore in connection with the examples as well as the further coating application technique of Example 1. The topcoating on this panel is measured and found to contain an acceptable 32 mg/sq ft. of chromium, as chromium, and 390 mg/sq. ft. of particulate zinc. A second of these panels was then prepared with approximately half of the foregoing topcoating weight thereby preparing a comparative panel not representative of the present invention. More particularly, the coating composition of Example 1 was used along with the foregoing coating procedures, with care being taken to provide a topcoating containing only 16.5 mg/sq. ft. chromium, as chromium, and 140 mg/sq. ft. of particulate zinc. The panels were then deformed and subjected to the hereinabove described corrosion resistance test. The results of such test are reported in the Table below.

TABLE 5

| Topcoat Weight on Nickel/Zinc | Salt Spray Corrosion on Formed Panels Red Rust Rating - Hours |
|---|---|
| Comparative Panel:Low Chromium | 4 - 288 |
| | Failed - 480 |
| Invention Panel:Acceptable Chromium | 0 - 288 |
| | 0 - 480 |
| | Failed - 1152 |

The efficacy of the corrosion resistance obtained on the coated and formed panels is, in part, quantitatively evaluated on a numerical scale from 0 to 8. The panels are visually inspected and compared with a photographic standard system used for convenience in the reviewing of results. In the rating system the following selected numbers, selected herein for their pertinency, are used:

(0) retention of film integrity, no red rust;
(4) less than 5% red rust basis total surface area of the dome;
(5) approaching 10% red rust on the dome;
(8) about 50% red rust on the dome

EXAMPLE 7

Cold-rolled steel panels were cleaned in the manner described hereinbefore in connection with the examples. After cleaning, the panels for testing were introduced into a bath maintained at 130° F. and containing a commercially available, ruthenium coated, titanium anode and the cold-rolled steel as cathode. A zinc-cobalt coating was deposited using a current density of about 27 ASF in 30 seconds coating time. The bath had a pH of about 2 and contained 105 g/l of $CoCl_2.6H_2O$, 25 g/l of $ZnCl_2$, 60 g/l of boric acid, all dissolved in deionized water.

After rinsing and drying one test panel was topcoated with a composition of Example 1 in the manner described hereinbefore in connection with the examples using the particular parameters of Example 1. The topcoating was found to contain 27 mg/sq. ft. of chromium, as chromium, and 340 mg/sq. ft. of particulate zinc. This topcoated panel, as well as one of the electrolytically prepared panels, but not topcoated, were then deformed and subjected to the above described corrosion resistance test. The topcoated panel had a test life of 1,008 hours in such testing whereas the non-topcoated panel was found to have a 48 hours test life. Test life was determined by duration in the test before the deformed panel achieved a rating of 5, using the numerical system of Example 6.

What is claimed is:

1. A coated metal substrate having enhanced corrosion resistance and protected by a coating composite comprising a thin metallic undercoating layer of a metal combination having at least one metal selected from the group consisting of zinc, nickel, iron, chromium, aluminum and cobalt, and a substantially resin-free topcoat layer from a hexavalent-chromium-containing bonding coating composition heat-curable to a water resistant protective coating, said topcoat layer containing particulate metal as well as above 20 milligrams per square foot of coated metallic undercoating of chromium, as chromium, in non-elemental form, said composition containing hexavalent-chromium-providing-substance in liquid medium.

2. The coated metal substrate of claim 1 wherein said metallic combination undercoating layer is an electrolytically produced metallic codeposit.

3. The coated metal substrate of claim 1 wherein said metallic combination undercoating layer is an electrodeposited alloy coating.

4. The coated metal substrate of claim 3 having a zinc-containing alloy as said metallic combination undercoating layer containing at most 95 weight percent zinc.

5. The coated metal substrate of claim 1 wherein said metallic combination undercoating layer is selected from the group consisting of zinc-nickel alloy, zinc-iron alloy, zinc-cobalt alloy, nickel-cobalt alloy and zinc-nickel-cobalt alloy.

6. The coated metal substrate of claim 1 having less than about 25 microns thickness metallic undercoating layer.

7. The coated metal substrate of claim 1 wherein said metallic combination undercoating layer is present in an amount from about 0.2 to about 15 microns thickness and contains greater than about 40 weight percent zinc.

8. The coated metal substrate of claim 1 wherein said substrate metal is selected from the group consisting of ferrous metal and zinc-, nickel-, cadmium-, cobalt-, and chromium-containing alloys.

9. The coated metal substrate of claim 1 wherein said substrate metal is ferrous metal, said ferrous metal is coated with a metallic pretreatment selected from the group consisting of nickel, cobalt, tin, copper and their mixtures where such exist and thereafter the undercoating layer covers said pretreatment.

10. The coated metal substrate of claim 9 wherein said metallic pretreatment is present in an amount providing a pretreatment thickness on the order of from about 0.1 micron to about one micron.

11. The coated metal substrate of claim 1 wherein said water resistant topcoat layer contains more than about 25 milligrams per square foot of coated metallic undercoating of said chromium in non-elemental form and is established from aqueous-based, heat-curable, composition.

12. The coated metal substrate of claim 1 having a baked-on, water-resistant topcoat layer containing more than about 20 weight percent but less than about 50 weight percent of said chromium in hexavalent form.

13. The coated metal substrate of claim 1 wherein said topcoat layer particulate metal is selected from the group consisting of zinc, aluminum, manganese, magnesium, mixtures thereof and alloys of same.

14. The coated metal substrate of claim 1 by having said water resistant topcoat layer containing said particulate metal in an amount above about 50 milligrams per square foot of coated metallic undercoating.

15. The coated metal substrate of claim 1 having said water resistant topcoat layer containing up to about 5,000 milligrams per square foot of coated metallic undercoating of said pulverulent metal and said topcoat layer further has a weight ratio of chromium, as chromium, to pulverulent metal of not substantially greater than 0.5:1.

16. The coated metal substrate of claim 1 wherein said water resistant topcoat layer is further coated.

17. The coated metal substrate of claim 1 wherein said water resistant and substantially resin free topcoat layer is further phosphate free.

18. A coated metal substrate having enhanced corrosion resistance and protected by a coating composite comprising a thin metallic electrodeposited undercoating layer containing metals in alloy form and including from about 40 to at most 95 weight percent zinc, and a heat curable, substantially resin free topcoat layer from hexavalent-chromium-containing bonding coating composition curable to a water resistant protective coating, said topcoat layer containing above about 50 milligrams per square foot of particulate metal as well as above about 25 milligrams per square foot of coated metallic undercoating of chromium, as chromium, in nonelemental form, said composition containing hexavalent-chromium-providing-substance in liquid medium.

19. A coated metal article in sheet or strip form having on one or both faces of said formed article a thin metallic undercoating layer of a metal combination having at least one metal selected from the group consisting of zinc, nickel, iron, chromium, aluminum and cobalt, while further having on one or both faces of said article a heat curable, substantially resin free topcoat layer from hexavalent-chromium-containing bonding coating composition curable to a water resistant protective coating, said topcoat layer containing particulate metal as well as above 20 milligrams per square foot of coated metallic undercoating of chromium, as chromium, in non-elemental form, said composition containing hexavalent-chromium-providing-substance in liquid medium.

20. The coated metal article of claim 19 being a coated steel coil.

21. The coated metal article of claim 19 wherein said metallic undercoating is an electrolytically produced metallic codeposit coating containing at most 95 weight percent zinc and said topcoating contains more than about 25 milligrams per square foot of coated substrate of chromium, as chromium, in non-elemental form.

* * * * *